US009097078B2

(12) United States Patent
Jensen et al.

(10) Patent No.: US 9,097,078 B2
(45) Date of Patent: Aug. 4, 2015

(54) DOWN HOLE EQUIPMENT REMOVAL SYSTEM

(75) Inventors: Michael Jensen, Copenhagen NV (DK); Wilhelmus Hubertus Paulus Maria Heijnen, Stromberg (DE); Engel Van Spronsen, Copenhagen K (DK)

(73) Assignee: MAERSK OLIE OG GAS A/S, Copenhagen K (DK)

( * ) Notice: Subject to any disclaimer, the term of this patent is extended or adjusted under 35 U.S.C. 154(b) by 1015 days.

(21) Appl. No.: 13/129,939

(22) PCT Filed: Nov. 18, 2009

(86) PCT No.: PCT/EP2009/065415

§ 371 (c)(1),
(2), (4) Date: Dec. 1, 2011

(87) PCT Pub. No.: WO2010/057932

PCT Pub. Date: May 27, 2010

(65) Prior Publication Data

US 2012/0061096 A1 Mar. 15, 2012

Related U.S. Application Data

(60) Provisional application No. 61/116,215, filed on Nov. 19, 2008.

(30) Foreign Application Priority Data

Nov. 19, 2008 (DK) ..... 2008 01617

(51) Int. Cl.
*E21B 29/02* (2006.01)

(52) U.S. Cl.
CPC ..... *E21B 29/02* (2013.01)

(58) Field of Classification Search
CPC ..... E21B 29/02; E21B 43/28
USPC ..... 166/376, 297, 298, 55
See application file for complete search history.

(56) References Cited

U.S. PATENT DOCUMENTS

| | | | | |
|---|---|---|---|---|
| 2,152,306 | A | 3/1939 | Grebe et al. | |
| 2,261,292 | A | 11/1941 | Salnikov | |
| 2,283,563 | A | 5/1942 | Lyons | |
| 2,436,197 | A | 2/1948 | Cardwell et al. | |
| 2,436,198 | A | 2/1948 | Cardwell et al. | |
| 4,157,732 | A * | 6/1979 | Fonner | 166/376 |
| 4,890,675 | A | 1/1990 | Dew | |

(Continued)

FOREIGN PATENT DOCUMENTS

| | | | |
|---|---|---|---|
| SU | 1712584 | A1 | 2/1992 |
| WO | 2005012684 | A2 | 2/2005 |
| WO | WO 2010/057931 | A1 | 5/2010 |

OTHER PUBLICATIONS

*Dachema Corrosion Handbook*, vol. 8, 1991, Ed. Behrens, ISBN: 3-527-26659-3, pp. 47-55.

Jegdic, Bore et al., "Corrosion potential of 304 stainless steel in sulfuric acid," *J. Serb. Chem. Soc.* 71 (5) (2006, JSCS-3447), pp. 543-551.

Stansbury, E.E. et al., "Fundamentals of Electrochemical Corrosion," 2000, ASM International, ISBN: 0-87170-676-8, pp. 113-149.

*Primary Examiner* — Catherine Loikith
(74) *Attorney, Agent, or Firm* — Brinks Gilson & Lione

(57) ABSTRACT

A method for removing downhole equipment installed in a well includes introducing an equipment dissolution mixture around the downhole equipment. The dissolution mixture includes one or more chemicals and/or materials suitable for the substantial dissolution of the downhole equipment.

20 Claims, 1 Drawing Sheet

(56) References Cited

U.S. PATENT DOCUMENTS

| | | | | |
|---|---|---|---|---|
| 5,024,812 | A | 6/1991 | Culling | |
| 5,165,476 | A | 11/1992 | Jones | |
| 5,778,995 | A | 7/1998 | McGarian | |
| 2005/0161224 | A1 | 7/2005 | Starr et al. | |
| 2005/0183892 | A1 | 8/2005 | Oldham et al. | |
| 2005/0205266 | A1 | 9/2005 | Todd et al. | |
| 2006/0131022 | A1 | 6/2006 | Rae et al. | |
| 2008/0149345 | A1 * | 6/2008 | Marya et al. | 166/376 |
| 2011/0048743 | A1 * | 3/2011 | Stafford et al. | 166/386 |

OTHER PUBLICATIONS

Wilde, B.E. et al., "The Variable Corrosion Resistance of 18Cr-8Ni Stainless Steels: Behavior of Commercial Alloys," *Corrosion*, vol. 25, No. 7, Jul. 1969, pp. 300-306.

Yilbas, B.S. et al., "The Corrosion Behavior of TiN Coated and UnCoated Incoloy 800 Alloy," *JMEPEG*, vol. 7(6), Dec. 1998, pp. 812-816.

International Search Report and Written Opinion for PCT:EP2009:065415, filed Mar. 25, 2010.

Danish Search Report for PA 2011 70246, completed May 27, 2015.

* cited by examiner

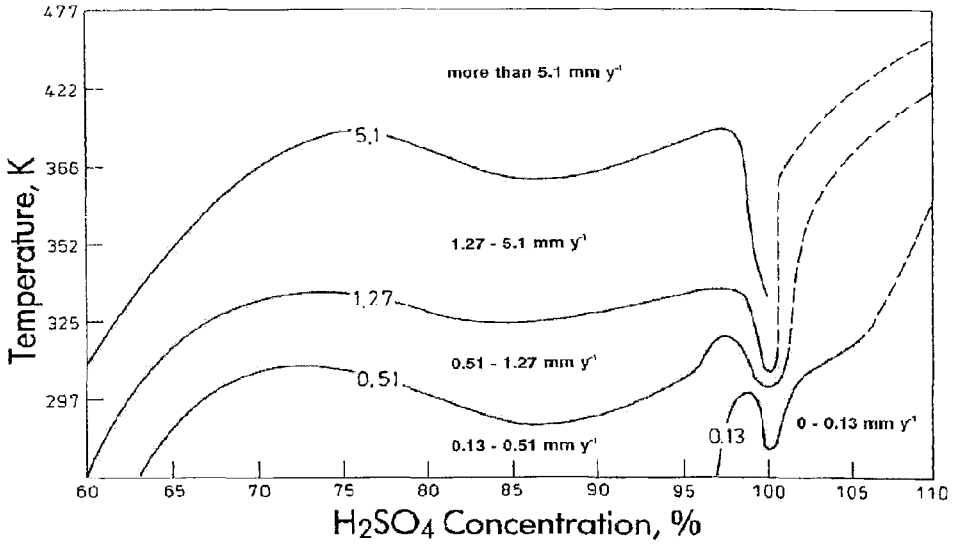
477
422
366
352
325
297
Temperature, K
more than 5.1 mm y⁻¹
5.1
1.27 - 5.1 mm y⁻¹
1.27
0.51 - 1.27 mm y⁻¹
0.51
0.13 - 0.51 mm y⁻¹
0.13
0 - 0.13 mm y⁻¹
60
65
70
75
80
85
90
95
100
105
110
H2SO4 Concentration, %

DOWN HOLE EQUIPMENT REMOVAL SYSTEM

RELATED APPLICATIONS

This application claims the benefit under 35 U.S.C. §371 of International Application No. PCT/EP2009/065415, having an International Filing Date of Nov. 18, 2009, which claims priority to Danish Application No. PA 2008 01617, filed Nov. 19, 2008, and U.S. Provisional Application No. 61/116,215, filed Nov. 19, 2008, the contents of all of which are incorporated herein by reference in their entirety.

FIELD OF THE INVENTION

The present invention relates to a method for removing downhole equipment from a well without retrieving the equipment. In particular, the present invention relates to a novel method of chemically removing downhole equipment. The method can be used among other things in the oil and natural gas industry.

BACKGROUND OF THE INVENTION

Oil, gas, water and geothermal wells are being drilled into the earth and normally such a bore hole is lined with steel and anchored by casting cement at the outside of these steel linings. Inside these steel walls equipment such as tubing, packers, side pocket mandrels, sliding side doors, surface or subsurface controlled valves and measurement tools can be installed either permanently or semi-permanently.

After the well has reached the end of its life either because of technical problems or because of becoming uneconomic or because of a license expiration, the well must be abandoned. There is typically a legal or contractual obligation to abandon the well in a specific manner and typically governmental guidelines or law describe precisely how a well must be abandoned. The typical procedure comprises retrieval of the tubing followed by removing the top of the well. This is the common practice for vertical wells, where the equipment is normally removed by simple retrieval.

Over many years the industry has developed methods to drill horizontal wells and has deployed this well type throughout the world. At the same time the industry has developed permanently and semi permanently installed equipment in this horizontal section, which cannot be retrieved as easily as the tubing of a vertical well. In some cases it is even physically impossible to retrieve these components due to obstructions in the well or partial collapse of the cemented lining, or because parts of the well have been corroded.

If the equipment cannot be removed by simple retrieval, e.g. because of the above problems, a downhole milling tool can be employed, which can mill the downhole equipment into small particles. U.S. Pat. No. 5,778,995 describes a downhole milling tool. Removing downhole equipment by milling requires the introduction of more advanced downhole equipment, as well as operation and maintenance of the milling tool. Furthermore if parts of the well have been partially obstructed by a collapse, the milling tool will not be able to function as intended.

U.S. Pat. No. 2,436,198 discloses a method which relate to chemical removal of an acid soluble metal part in a deep well. One object of the invention of U.S. Pat. No. 2,436,198 is to provide an improved method of, and composition for, chemically dissolving an aluminium or aluminium alloy part, such as a casing section, in the bore of a well whereby complete rapid removal is achieved. Dissolution of parts or equipment made of Al or Al-alloys in the well is achieved by subjecting the metal part of the corroding action of a hydrochloric acid solution to which has been added a relatively small amount of a phosphorus acid such as phosphoric acid ($H_3PO_4$) and hypo-phosphorous acid ($H(H_2PO_2)$). To prevent or reduce attack by the acid solution on adjacent ferrous metal parts, when such are present, an inhibitor of such action may be included in the acid solution.

U.S. Pat. No. 2,261,292 discloses a method for completing wells which traverse a plurality of producing horizons and has as particular object a completion procedure which will enable the operator to produce from various horizons simultaneously. According to the method comprise the string of casing which is set has one or more sections arranged so as to be opposite the upper producing horizons, and composed of a metal or a material which can be readily removed chemically. For example the material may be an aluminium alloy or a magnesium alloy or it may be an acid or alkali soluble resin. The chemical is an acid or a strong alkali e.g. hydrochloric acid.

U.S. Pat. No. 4,890,675 discloses a method for drilling of horizontal boreholes through formations traversed by a cased well. According to the method is provided a casing section adjacent to the formation which section is readily soluble in a selected chemical solution contacting the casing section with the selected chemical solution to dissolve the casing section and provide a "window" to the formation, and then drilling at least one generally horizontal borehole through the window into the formation. The removable section can be formed of Al or Mg, or an alloy of Al or Mg. The selected chemical solution may be an acid or an alkali. To minimize damage to the rest of the casing, a caustic solution is preferred. A strong hydroxide with alkali metal or ammonium nitrate is particularly effective in dissolving Al or Mg.

US 2005/0205266 relates to biodegradable downhole tools i.e. disposable tools, such as frac plugs and methods of removing such tools from wellbores. The disposable downhole tool or a component of the tool can comprise a degradable polymer e.g. an aliphatic polyester.

There exists a need for an improvement of the existing methods for the removal of downhole equipment that does not suffer the drawbacks described above.

SUMMARY OF THE INVENTION

The present invention was made in view of the prior art described above, and the object of the present invention is to provide a practical method capable of chemically removing easily and reliably downhole equipment.

To solve the problem, the present invention provides a method for substantially dissolving downhole equipment, the method comprising introducing around the downhole equipment an equipment dissolution mixture comprising one or more chemicals and/or materials suitable for the substantial dissolution of the downhole equipment.

In an embodiment the method further comprises one or more initial and/or intermediate steps of substantially removing coatings on the downhole equipment. The method may further comprise flowing the equipment dissolution mixture around the downhole equipment as well as aerating the equipment dissolution mixture with a gas.

When the downhole equipment consists mainly of one or more metals and/or metal alloys, e.g. steels, the dissolution of the downhole equipment can proceed mainly through corrosion, for instance via loss of electrons from metal.

When the downhole equipment consists mainly of one or more metals and/or metal alloys, the equipment dissolution mixture can comprise an acid or mixture of acidic compounds, and can further be combined with one or more additives and/or catalysts.

When the downhole equipment is situated in a $CaCO_3$ reservoir, an equipment dissolution mixture comprising, for example, 1-98.3% sulfuric acid also reduces the potential leaking of equipment dissolution mixture to the surrounding reservoir formation by creating a flow barrier between the downhole equipment, and the surrounding reservoir. When the downhole equipment is situated in a sandstone reservoir an equipment dissolution mixture consisting of, for example, hydrofluoric acid can function in a similar manner to reduce the potential leaking of equipment dissolution mixture to the surrounding reservoir formation by creating a flow barrier.

BRIEF DESCRIPTION OF THE DRAWINGS

The FIGURE shows an isocorrosion diagram for unalloyed steel and cast steel in static sulfuric acid as a function of sulfuric acid concentration in %, and temperature in 30 Kelvin (Dechema Corrosion Handbook, vol. 8, 1991, Ed. Behrens, ISBN 3-527-26659-3, p48). It can be seen that a corrosion penetration rate higher than 5.1 mm/y (>200 mpy) can be achieved at different concentrations defined by the line marked "5.1", e.g. at concentrations around 60% sulfuric acid and above ~310 K (37° C.).

DETAILED DESCRIPTION OF THE INVENTION

The downhole equipment removal method of the present invention allows downhole equipment to be at least partly removed from e.g. an oil well without having to retrieve it. The method of the present invention is directed to the removal of downhole equipment which comprise steel, such as carbon steel or corrosion-resistant steel. Carbon steel is an alloy consisting mostly of iron with a content of carbon between 0.2% and 2.2% by weight depending on the grade, whereas stainless steel, which is a type of corrosion-resistant steel that typically have a minimum of 10.5 or 11% chromium content by mass. Normally, at least 50% of the downhole equipment to be treated or removed according to the present method will be constituted by steel.

The method has been illustrated with reference to oil, gas, water and geothermal wells. However, a person skilled in the art would appreciate that the downhole removal method as described herein can be extended to any related application.

The invention relates to a method that substantially dissolves i.e. removes downhole equipment. A "substantial dissolution" is defined by the operator as the dissolution which is necessary under the given circumstances. Normally, a "substantial dissolution" is defined as the removal of at least 50%, e.g. at least 60%, at least 70%, at least 80%, at least 90%, or at least 95% of the downhole equipment. The method comprises introducing an equipment dissolution mixture downhole. The equipment dissolution mixture is left downhole, and will after some time cause a substantially dissolution of the downhole equipment. The dissolution rate for various combinations of equipment, mixtures and conditions can be determined as described in the examples under the heading "Calculating the corrosion rate" and "Estimation of corrosion rate by the use of test samples".

Typically the downhole equipment (comprising the pipe itself and the equipment inside and around the pipe, such as tubing, packers, side pocket mandrels, sliding side doors, packers, surface or subsurface controlled valves and measurement tools) are made out of different types of materials. The types of material can be different types of metals, metal alloys, polymer coatings, rubbers, and plastics. It is these types of materials that will be dissolved, or at least substantially dissolved using the method of the invention.

One cannot rely on 'natural' erosion/corrosion alone to substantially dissolve downhole equipment, as this would take prohibitively long. Consequently, in order to remove the downhole equipment within a reasonable timeframe the addition of one or more equipment dissolution mixtures is warranted. The equipment dissolution mixture comprises one or more chemicals and/or materials suitable for the substantial dissolution of the downhole equipment. Ideally one mixture will remove all types of materials. However, typically one equipment dissolution mixture will be used to dissolve e.g. metals and metal alloys, and another equipment dissolution mixture will be used to dissolve e.g. polymer coatings, rubbers, and plastics. These non metallic materials can be dissolved by, for example, fluids containing aromatic rings.

Purging the downhole equipment for spent equipment dissolution mixture, and introducing a different, or identical equipment dissolution mixture may be necessary depending on the type and dimensions of the equipment.

In one embodiment the method further comprises one or more initial and/or intermediate steps of substantially removing coatings such as linings on the downhole equipment. Removing coatings including organic coatings may involve the degreasing of the downhole equipment, delaminating coatings, such as e.g. Teflon®, PVDF, the removal of ebonite, powder, plastic or polymer coatings, as well as stripping paints, lacquers waxes and greases. Examples of degreasers for downhole equipment are acetone, benzene, toluene, and other organic solvents. Teflon can be delaminated by using N-Terpinal™ (WSI industries, 1325 W. Sunshine St. #551, Springfield, Mo. 65807, USA), and can also be used to strip many other coatings, such as epoxies, urethanes, powder coatings and paints.

In a further embodiment the equipment dissolution mixture is flowed around the downhole equipment. One of the advantages of applying a flow to the mixture is that in addition to the chemical actions of the mixture, the mechanical action of the applied flow on the downhole equipment further adds to the removal of the downhole equipment by mechanically removing small fragments such as coatings and linings of the downhole equipment. Another advantage is that mechanically removing coatings on the downhole equipment can significantly speed up the chemical dissolution of the equipment. The mechanical effect of flowing the downhole equipment dissolution mixture can be enhanced by the presence and/or addition of particulate matter such as sand or shrapnel, and in the case of a liquid downhole equipment dissolution mixture, the dissolved gasses, or external aeration of the equipment dissolution mixture with a gas will also enhance the mechanical effect of flowing the equipment dissolution mixture. The mechanical effect of flowing the downhole dissolution mixture increases with increasing flow, such as for example, >0.5 m/s, >0.9 m/s, >1 m/s, >2 m/s, >3 m/s, >4 m/s, >5 m/s, >10 m/s, >15 m/s, >20 m/s, >25 m/s, >30 m/s.

A further advantage of circulating the equipment dissolution mixture is obtained for downhole equipment made out of steel. Steel can form an oxidized protective film/coating on the surface of the metal, even in corrosive solutions. Increasing the fluid velocity helps to remove these surface coatings, thereby increasing the corrosion rate. Furthermore, increasing fluid velocity may, to a certain extent, increase the corrosion rate by reducing the diffusion layer thickness, see e.g. E. E. Stansbury and R. A. Buchanan, Fundamentals of Electrochemical Corrosion, 2000, ASM International, ISBN: 0-87170-676-8, p 113-114ff, 145ff.

Typically the metal parts of the downhole equipment are made out of steel, where the main component usually is iron. Many types of steel are used, such as carbon steel or stainless steel, for example the API steel grades C75, L80, C95, P110, and API types L80-13Cr, 9Cr1 Mo, Incoloy® and Inconel®. Stainless steel differs from carbon steel by the amount of chromium present. Stainless steel, also known as inox steel or inox, is defined as a steel alloy with a minimum of 10.5 or 11% chromium content by mass.

Typical compositions of the various alloys are shown in table 1 below.

TABLE 1

| Compositions of various alloys in % | | | | | | | | | | | |
|---|---|---|---|---|---|---|---|---|---|---|---|
| Alloy | Fe | C | Mn | P | S | Si | Cr | Ni | Mo | Cu | Other |
| Incoloy ® | Balance | 0.05 | 1 | — | 0.03 | 0.5 | 23.5 | 46 | 3 | 2.5 | — |
| Inconel ® | Balance | 0.08 | 0.35 | 0.015 | 0.015 | 0.35 | 20 | 55 | 3 | 0.3 | 1 Co<br>5 Nb |
| Monel ® K-500 | ≤2 | ≤0.25 | ≤1.5 | — | ≤0.01 | ≤0.50 | — | ≥63 | — | 27-33 | 2.3-3.15 Al<br>0.35-0.85 Ti |
| 316 L | Balance | 0.03 | 2 | 0.045 | 0.03 | 1 | 17 | 12 | 2.5 | — | — |
| 13 Cr | Balance | 0.22 | 1 | 0.02 | 0.01 | 1 | 13 | 0.5 | — | 0.25 | — |
| L80 | Balance | 0.43 | 1.9 | 0.03 | — | 0.45 | — | 0.25 | — | 0.35 | — |
| Carbon steel | Balance | 0.14 | 0.9 | 0.04 | 0.05 | — | — | — | — | — | — |

The dissolution of the downhole equipment proceeds mainly through corrosion, which is the chemical and/or electrochemical reaction between the metals and/or metal alloys and the downhole dissolution mixture.

In a further embodiment the corrosion of the downhole equipment proceeds mainly via loss of electrons from metal. Corrosion that proceeds via loss of electrons from the metals and/or metal alloys comprises the following reactions, which are considered the simplest corrosion reactions (M=metal):

$$M+mH^+ \rightarrow M^{m+}+\tfrac{1}{2}mH_2 \text{ at pH}<7$$

$$M+mH_2O \rightarrow M^{m+}+mOH^-+\tfrac{1}{2}mH_2 \text{ at pH}\geq 7$$

Thus, the metal passes from the metallic state to ions of valence m in solution with the evolution of hydrogen.

If dissolved oxygen is present in the solution, usually from contact with air (aerated environment), the following reactions apply in addition to those considered above.

$$M+\tfrac{1}{4}mO_2+mH^+ \rightarrow M^{m+}+\tfrac{1}{2}mH_2O \text{ at pH}<7$$

$$M+\tfrac{1}{4}mO_2+\tfrac{1}{2}mH_2O \rightarrow M^{m+}+mOH^- \text{ at pH}\geq 7$$

For a specific example, such as the corrosion of iron, the following overall reaction in acid solution (at pH<7) will be:

$$Fe+2H^+ \rightarrow Fe^{2+}+H_2$$

$$Fe+\tfrac{1}{2}O_2+2H^+ \rightarrow Fe^{2+}+H_2O$$

When dealing with corrosion of metals and metal alloys it can be advantageous to reduce the time by which substantial corrosion occurs. This can be done by increasing the corrosion rate. Corrosion rate is typically expressed as corrosion intensity (CI), in units of mass-loss per unit area per unit time, and corrosion penetration rate (CPR) in units of loss-in-dimension perpendicular to the corroding surface per unit time. Typically corrosion rates can be obtained by measuring a corrosion current density and applying Faraday's law in order to calculate a corrosion rate. The measurement of corrosion current density is known to the skilled person, and is described e.g. in E. E. Stansbury and R. A. Buchanan, Fundamentals of Electrochemical Corrosion, 2000, ASM International, ISBN: 0-87170-676-8 which is hereby incorporated by reference in its entirety. Another way of measuring the corrosion rate is by subjecting a metal or metal alloy to the corrosive environment for a specified time, and measure a weight difference due to corrosion (see the examples under the heading "Estimation of corrosion rate by the use of test samples"). The weight difference can be correlated to e.g. a corrosion penetration rate (see the examples under the heading "Calculating the corrosion rate"). The two exemplified methods described above provide means for calculating a corrosion rate, and to estimate the time needed to substantially corrode the metal and metal alloy parts of the downhole equipment.

One typical unit of corrosion penetration rate is mpy, which is "mils per year" corrosion. One mil is one thousand of an inch. Thus, a corrosion penetration rate of 100 mpy corresponds to 2.54 mm/y. This means that a pipe with a wall thickness of 5 mm will disappear within 2 years if it is subjected to a corrosion penetration rate of 100 mpy.

The corrosion rate depends on many variables, such as the type of metal and metal alloy, the type of equipment dissolution mixture, the fluid velocity of the equipment dissolution mixture, the temperature, the pressure and/or galvanic activity. The below table 2 illustrates the estimated time (in months, m) to dissolve/corrode a pipe with a typical outside diameter of 4.5 inch with a 6 mm wall thickness to a substantial degree of at least 50%:

TABLE 2

| CPR | Degree of corrosion | | | | | |
|---|---|---|---|---|---|---|
| (mpy) | 50% | 60% | 70% | 80% | 90% | 95% |
| 100 | 14 m | 17 m | 20 m | 23 m | 26 m | 27 m |
| 200 | 7 m | 9 m | 10 m | 11 m | 13 m | 13 m |
| 300 | 5 m | 6 m | 7 m | 8 m | 9 m | 9 m |
| 400 | 4 m | 4 m | 5 m | 6 m | 6 m | 7 m |
| 500 | 3 m | 3 m | 4 m | 5 m | 5 m | 5 m |
| 600 | 2 m | 3 m | 3 m | 4 m | 4 m | 4 m |
| 700 | 2 m | 2 m | 3 m | 3 m | 4 m | 4 m |
| 800 | 2 m | 2 m | 2 m | 3 m | 3 m | 3 m |
| 900 | 2 m | 2 m | 2 m | 3 m | 3 m | 3 m |
| 1000 | 1 m | 2 m | 2 m | 2 m | 3 m | 3 m |
| 1500 | <1 m | 1 m | 1 m | 2 m | 2 m | 2 m |
| 2000 | <1 m | <1 m | 1 m | 1 m | 1 m | 1 m |

The time to corrode can be divided into three categories, 0-6 months, 6-12 months and >12 months. If a substantial corrosion rate for a pipe as described above is to be obtained in less than 1 year, a corrosion penetration rate larger of 200 mpy or above would be necessary, depending on the degree of substantial corrosion. A corrosion rate above 4 mpy corresponding to 0.1 mm/year corrosion is the boundary between acceptable and unacceptable performance. Examples of corrosion rates according to the invention is: >4 mpy, >10 mpy, >20 mpy, >30 mpy, >40 mpy, >50 mpy, >60 mpy, >70 mpy, >80 mpy, >90 mpy, >100 mpy, >200 mpy, >300 mpy, >400 mpy, >500 mpy, >600 mpy, >700 mpy, >800 mpy, >900 mpy, >1000 mpy, >1500 mpy, >2000 mpy at the specific ambient, or elevated temperatures downhole.

In order to increase the corrosion rate of metal and metal alloys various equipment dissolution mixtures can be introduced to the downhole equipment. In one embodiment the equipment dissolution mixture modifies the pH of the downhole environment to a pH range below neutral pH, such as e.g. below pH 7. In one embodiment the equipment dissolution mixture comprises an acid or mixture of acidic compounds. The acid or mixture of acidic compounds can for example be chosen from one or more of the following: sulfuric acid, hydrochloric acid, nitric acid, hydrofluoric acid, phosphoric acid, lactic acid, tannic acid, oxalic acid, and mixtures thereof. The corrosion rate can be influenced by changing the concentration and specific combination of acids in the equipment dissolution mixture. As evident from the FIGURE, it can be seen that a corrosion penetration rate higher than 5.1 mm/y (>200 mpy) can be achieved at different concentrations defined by the line marked "5.1", e.g. at concentrations around 60% sulfuric acid and above −310 K (37° C.).

According to the invention, the dissolution of the downhole equipment in general, as well as the corrosion rate of metals and metal alloys can further be increased by the addition of one or more suitable additives and/or catalysts. Depending on the metal or metal alloy to be dissolved one or more of the following additives and/or catalysts can be used: hydrogen peroxide, hydrogen sulphide, oxygen, carbon dioxide, and salts containing: halogenide such as chloride ion, bromide ion, fluoride ion, sulphide ion, thiocyanate ion, nitrite ion, and mixtures thereof. Additives can for example be oxidising agents or additives which change the surface chemistry by forming a film on the surface preventing further re-oxidation. Common oxidising agents comprise for example: oxygen ($O_2$), ozone ($O_3$), the halogens: fluorine ($F_2$), chlorine ($Cl_2$), bromine ($Br_2$), iodine ($I_2$), hypochlorite ($OCl^-$), chlorate ($ClO_3^-$) nitric acid ($HNO_3$), Hexavalent chromium: chromium trioxide ($CrO_3$), chromate ($CrO_4^{2-}$), dichromate ($Cr_2O_7^{2-}$), permanganate ($MnO_4^-$), manganate ($MnO_4^{2-}$), hydrogen peroxide ($H_2O_2$), and other peroxides.

In one embodiment the acid component of the equipment dissolution mixture is sulfuric acid. The sulfuric acid can be concentrated or diluted. Dilution of concentrated sulfuric acid is an exothermic reaction, and can be done prior to introducing the equipment dissolution mixture comprising sulfuric acid, or advantageously, after the introduction of sulfuric acid downhole. As heat is generated when the acid is diluted warmer conditions can be present locally, which can further increase the initial corrosion rate, since increasing the temperature increases the corrosion rate, see e.g. Dechema Corrosion Handbook, vol. 8, 1991, Ed. Behrens, ISBN 3-527-26659-3, p49.

Sulfuric acid is oxidising when concentrated but is reducing at low and 'intermediate' concentrations. The response of most stainless steel types is that in general they are resistant at either low or high concentrations, but are attacked at intermediate concentrations. Commercially concentrated acid is around 95-98 wt % (density 1.84 g/cm$^3$). Examples of such intermediate concentrations are from 60-95%, 60-80

The presence of additives such as chlorides in sulfuric acids can additionally increase the corrosion. Hydrochloric acid (HCl) can be liberated from sodium chloride (or generally any other chloride salt) by sulfuric acid, depending on the temperature, making the equipment dissolution mixture more aggressive.

Chromium content is important to the resistance of the steel, which means that AISI 310 steel (Fe, <0.25% C, 24-26% Cr, 19-22% Ni, <2% Mn, <1.5% Si, <0.45% P, <0.3% S) are more corrosion resistant than AISI 304 steel (Fe, <0.08% C, 17.5-20% Cr, 8-11% Ni, <2% Mn, <1% Si, <0.045% P, <0.03% S) due to the extra chromium present in that alloy.

Stainless steels have a lower corrosion rate than carbon steels at any flow rate of concentrated acid. This is because the passive layer on stainless steels is more stable than the ferrous sulphate layer formed on carbon steel under any flow condition.

In a further embodiment, the downhole equipment can be penetrated locally by corrosion or collapsed thereby providing access to the formation surrounding the borehole. This can cause leaking of the equipment dissolution mixture to the earth formation in which the well was drilled, resulting in the need to introduce more equipment dissolution mixture to dissolve the downhole equipment.

The leaking will further add to the cost of dissolving the downhole equipment, and it is consequently advantageous to minimize any leaking of active equipment dissolution mixture, by creating a flow barrier between the earth formation in which the well has been drilled, and the downhole equipment to be dissolved.

When the downhole equipment is situated in a calcium-rich reservoir it is advantageous to use an acid in combination with a source of sulphate ions ($SO_4^{2-}$), for example sulfuric acid itself. The sulfuric acid can be present in any concentration from around 1-98.3%. The sulfuric acid will dissolve the calcium-rich material, such as e.g. calcium carbonate $CaCO_3$, which in turn will re-precipitate as calcium sulfate with varying amounts of water, such as for example gypsum ($CaSO_4$, $2H_2O$) thereby creating a flow barrier that effectively minimizes the leak of equipment dissolution mixture to the earth formation in which the well was drilled. Since gypsum and related calcium sulphate materials have a higher molar volume than calcium carbonate itself ($CaCO_3$ ~37 cm$^3$/mol vs. gypsum ~75 cm$^3$/mol), any cracks in the calcium-rich formation surrounding the downhole equipment will be plugged and sealed by excess volume of calcium sulphate resulting in a calcium sulphate lined formation, which significantly reduces or stops the leak. Leaks may arise through holes made in the tubing due to e.g. corrosion. It is further advantageous to have, and be able to contain the equipment dissolution mixture both on the inside and the outside of the downhole equipment. This is because the equipment dissolution mixture will be in contact with both sides of the pipe that make up a large part of the downhole equipment to be dissolved. The ability to contact the inside as well as the outside of the pipe, without significant leaks of the equipment dissolution mixture to the surrounding formation effectively doubles the corrosion rate, and thereby reduces the time of substantial corrosion considerably.

When the equipment dissolution mixture for calcium-rich reservoirs comprises sulfuric acid, it can further be added another source of $H^+$, such as hydrochloric acid. Increasing the ratio between $H^+$ (that dissolves calcium-rich material, such as e.g. $CaCO_3$) and $SO_4^{2-}$ (which precipitates a calcium sulfate compound) results in more dissolved calcium-rich material that in turn can be precipitated. Increasing the ratio $H^+/SO_4^{2-}$ can be beneficial if a larger plug of gypsum is to be formed.

Specific compositions, and the correlation between flow rate, injection time, ratio, concentration, etc. has been described in detail in the co-pending application titled "Sealing of Thief Zones" (internal reference: P80704218, DK patent application PA 2008 01618, U.S. provisional application 61/116,226) with concurrent filing date and similar inventorship (hereinafter referred to as "the co-pending application"), which is hereby incorporated by reference in its entirety.

When the downhole equipment is situated in a sandstone reservoir it is advantageous that the equipment dissolution mixture comprise hydrofluoric acid, as hydrofluoric acid will dissolve sandstone, and precipitate silica, which will result in pore clogging, and thus a reduction in leaking of the equipment dissolution mixture to the surrounding reservoir.

Consequently, the equipment dissolution mixture used may have two functions, one being to substantially dissolve the downhole equipment in the well bore and second to prevent fluid loss to the surrounding reservoir.

It will be understood by the skilled person that the described aspects and embodiments of the present invention can be used in any combination.

The present invention can be used in all fields wherein the removal of equipment is desired, and particular for use in down-hole operations in the oil and gas industry. If desired, part of a section can be corroded selectively by sealing off that section and introducing an equipment dissolution mixture into the section to be corroded.

Concentrations in % are w/w unless otherwise stated.

Fluids, such as the equipment dissolution mixture can be liquid and/or gaseous. Furthermore the definition of a liquid and/or gaseous equipment dissolution mixture comprises aqueous and organic mixtures, solutions, suspensions, emulsions and the like.

The following examples are merely an illustration of the invention, and should not be construed in a limiting way.

EXAMPLES

Calculating the Corrosion Rate

Corrosion evaluation is carried out in several ways. The simplest method is measurement of material loss after exposure to a particular environment. The corrosion rate in mils per year (mpy) is then given by:

$$\text{Corrosion rate}(mpy)=(534\cdot w)/(d\cdot A\cdot t) \qquad \text{Formula 1:}$$

Where w—weight loss in mg, d—alloy density in g/cm$^3$, A—area in square inch, and t—exposure time in hours A corrosion rate of 100 mpy penetration corresponds to 2.54 mm/y.

Estimation of Corrosion Rate by the Use of Test Samples

A corrosion sample test bar is machined into 1½ inch diameter by ¼ inch thick discs, each disc having a ⅛ inch diameter hole in the centre. Each of the discs is polished to a 600 grit finish, and is cleaned by carbon tetrachloride to remove residual machining oil and grit, followed by cleaning in detergent and hot water and is finally dried.

Each clean, dry disc to be used in the corrosion test is weighed to the nearest 10,000th of a gram and suspended in one of the test solutions by a platinum wire for an appropriate exposure period.

After exposure, test samples are then cleaned with a nylon brush and tap water, dried, and again the test samples are weighed to the nearest 10,000th of a gram. The corrosion rate of each disc, in mils per year (mpy), is calculated by formula 1.

Estimation of Corrosion Rate of 304 Stainless Steel

Using a modification of formula 1, it is possible to estimate the time needed to corrode various downhole equipment with specific downhole dissolution mixtures for which corrosion rates are known or estimated e.g. by using test samples described above.

$$t=(22250\cdot w)/(d\cdot A\cdot mpy)$$

Where w—weight loss in g, d—alloy density in g/cm$^3$, A—area in square inch, and t—exposure time in days 304 stainless steel exhibits a corrosion rate of 247 mpy in $H_2$ saturated 1N $H_2SO_4$ @30° C. (B. E. Wilde and N. D. Greene, Jr., The Variable Corrosion Resistance of 18Cr-8Ni Stainless Steels: Behavior of Commercial Alloys, *Corrosion* 25, 1969, p300-304).

Taking as an example the substantial corrosion (at least 50%) of a 40 inch long 304 stainless steel pipe with an outer diameter of 4.5 inch, a wall thickness of 6 mm, and a density of 8.03 g/cm$^3$.

$$mpy=247$$

$$\text{density}=d=8.03\ g/cm^3$$

$$\text{length of pipe}=l=40\ \text{in}\cdot 2.54\ \text{cm/in}=101.6\ \text{cm}$$

$$\text{outer radius}=r_{outer}=\tfrac{1}{2}\cdot 4.5\ \text{in}\cdot 2.54\ \text{cm/in}=5.715\ \text{cm}$$

$$\text{inner radius}=r_{inner}=5.715\ \text{cm}-0.6\ \text{cm}=5.115\ \text{cm}$$

$$\text{mass of pipe}=m_{pipe}=\pi\cdot(r_{outer}^2-r_{outer}^2)\cdot l\cdot d=16655\ g$$

$$\text{inner area}=A=2\cdot\pi\cdot r_{inner}\cdot l=10.155\ \text{sq in/cm}^2=506.1\ \text{sq in}$$

$$\text{weight loss}=w=50\%\cdot 16655\ g=8327.5\ g$$

$$t=(22250\cdot w)/(d\cdot A\cdot mpy)=185\ \text{days}=6\ \text{months}$$

Since the inner area (A) and the weight loss (w) are both proportional with regards to the length of the pipe (l), the above time estimate is not only valid for a 40 inch section of the pipe, but for any length of pipe.

Example 1

Dissolving a 10,000 ft Section of Steel Pipe Downhole

A 10,000 ft (3048 m) section of 4.5 inch outer diameter and 6.9 mm wall thickness downhole steel pipe weighing 126,000 lbs (57.154 kg) is corroded by the addition of at least 112 m$^3$ 60% $H_2SO_4$ either mixed on the topside, or downhole. If the 60% sulfuric acid is mixed downhole, this can for instance be done by the following steps: 1) pumping the water from the annulus; 2) pumping the concentrated sulfuric acid downhole through a 1-2 inch pipe from the production side.

The volume of the specific pipe section exemplified is ~24 m$^3$. Every month the section of pipe is purged, and new acid solution is introduced. This is repeated until the pipe is fully corroded. The hydrogen, which is formed due to the dissolution reactions, is being 'vented' to the surface via a small pipe connected to the area where the equipment is being dissolved. At surface the volume of hydrogen is measured before it is vented into a burning flare. When the forming of hydrogen is approaching zero per unit time there are two possibilities. In case the theoretical volume of acid is not used it means that a new batch of acid is to be introduced. In case the theoretical volume of acid is substantially exceeded and the hydrogen concentration is approaching zero per unit time it can be concluded that no reactions are taken place anymore meaning that the metals are dissolved.

Example 2

Determining Corrosion Rate of Schlumberger Coil Tubing Material

Test Conditions:

Test solution: 0.3 M HCl+1.5 M $H_2SO_4$ @ 80° C., deaerated and fully stirred. Test specimens 5.5×3.0 cm are cut from the coiled tubing (carbon steel—HS80™: Chemical composition: C, 0.10-0.15 range; Mn, 0.60-0.90 range; P, 0.03 max; S, 0.005 max; Si, 0.30-0.50 range; Cr, 0.45-0.70 range; Cu, 0.40 max; Ni, 0.25 max). One specimen is ground to grit 500 on all surfaces. All other specimens are only deburred. The test specimens are degreased by immersion in acetone and ethanol.

Experimental Procedure:

The test solution is prepared from reagent grade acids and distilled water. The test cell is surrounded by a heating jacket and contains 2000 ml of test solution. The temperature is maintained at 80° C. within ±1° C. The test solution is stirred vigorously. The test cell is purged with nitrogen (150 $cm^3$/min). The purge is started at least 30 min before specimen immersion. The purge continues throughout the test.

Two test specimens at a time are immersed in the solution for 24 hours. The test specimens are weighed prior to the test in order to calculate corrosion rate from the weight loss. The test specimens are kept free hanging in the test solution using polypropylene sewing thread.

At test termination the specimens are rinsed in distilled water, rinsed with ethanol and dried using hot air. Weight loss due to corrosion is recorded.

Results:

All test specimens were completely corroded during the 24 hours test duration. Only a very thin netlike structure remained of some of the samples. As a result it made no sense to do weight measurements as the corrosion rate can be directly determined by measuring the wall thickness of the original piping material. By doing so the corrosion rate is determined to be ~1.4-1.5 mm/day, i.e. a corrosion rate of ~1.4-1.5 mm/day can be obtained under the above described conditions.

The invention claimed is:

1. A method for removing downhole equipment installed in a well, the method comprising:

introducing around the downhole equipment an equipment dissolution mixture comprising an acid or mixture of acidic compounds, wherein the downhole equipment corresponds to downhole equipment that is in the well at an end of a production lifetime of the well, and where at least part of the downhole equipment is made of steel; and dissolving the downhole equipment that exists in the well at the end of the production lifetime of the well with the equipment dissolution mixture to thereby remove the downhole equipment.

2. The method as described in claim 1, wherein the substantial dissolution of downhole equipment is at least 80%.

3. The method according to claim 2, wherein the steel is selected from the group consisting of: stainless steel, Incoloy®, Inconel®, Monel® K-500, 316L, 13Cr, L80, and carbon steel.

4. The method according to claim 2, further comprising substantially removing coatings on the downhole equipment.

5. The method according to claim 2, further comprising flowing the equipment dissolution mixture around the downhole equipment.

6. The method according to claim 2, further comprising aerating the equipment dissolution mixture with a gas.

7. The method according to claim 1, wherein the steel is selected from the group consisting of: stainless steel, Incoloy®, Incone®, Monel® K-500, 316L, 13Cr, L80, and carbon steel.

8. The method according to claim 7, wherein the stainless steel is an API steel with a steel grade selected from the group of API steel grades consisting of: C75, L80, C95, P110, and API types 13Cr, 9Cr1Mo.

9. The method according to claim 1, further comprising substantially removing coatings on the downhole equipment.

10. The method according to claim 1, further comprising flowing the equipment dissolution mixture around the downhole equipment.

11. The method according to claim 10, wherein the equipment dissolution mixture is circulated at a flow rate of 1 m/s or more.

12. The method according to claim 1, further comprising aerating the equipment dissolution mixture with a gas.

13. The method according to claim 1, wherein the equipment dissolution mixture further comprises one or more additives or catalysts.

14. The method according to claim 13, wherein the acid or mixture of acidic compounds are selected from the group consisting of: sulfuric acid, hydrochloric acid, nitric acid, hydrofluoric acid, phosphoric acid, lactic acid, tannic acid, oxalic acid, and mixtures thereof.

15. The method according to claim 13, wherein the one or more additives or catalysts are selected from the group consisting of: hydrogen peroxide, hydrogen sulphide, oxygen, carbon dioxide, and halogenide salts.

16. The method according to claim 15, wherein the halogenide salt is selected from the group consisting of: chloride ion, bromide ion, fluoride ion, sulphide ion, thiocyanate Ion, nitrite ion, and mixtures thereof.

17. A method for removing permanently installed downhole equipment installed in a well, the method comprising:

introducing around the downhole equipment an equipment dissolution mixture comprising an acid or mixture of acidic compounds, where at least part of the permanently installed downhole equipment is made of steel, wherein the equipment dissolution mixture forms a precipitate with a component originating from a surrounding reservoir when the dissolution mixture gets in contact with the surface of the reservoir.

18. The method according to claim 17, wherein the downhole equipment is situated in a calcium-rich reservoir and the equipment dissolution mixture comprises 1-98.3% sulfuric acid.

19. The method according to claim 18, wherein the equipment dissolution mixture additionally comprises at least one second source of $H^+$.

20. The method according to claim 17, wherein the downhole equipment is situated in a sandstone reservoir and the equipment dissolution mixture consists of hydrofluoric acid.

* * * * *

UNITED STATES PATENT AND TRADEMARK OFFICE

CERTIFICATE OF CORRECTION

PATENT NO. : 9,097,078 B2
APPLICATION NO. : 13/129939
DATED : August 4, 2015
INVENTOR(S) : Michael Jensen et al.

It is certified that error appears in the above-identified patent and that said Letters Patent is hereby corrected as shown below:

In the Claims

In column 12, claim 7, line 10, after "Incoloy®," replace "Incone®," with --Inconel®,--.

Signed and Sealed this
Fifteenth Day of March, 2016

Michelle K. Lee

Michelle K. Lee
*Director of the United States Patent and Trademark Office*